US005992402A

United States Patent [19]

Vyprachticky

[11] Patent Number: 5,992,402

[45] Date of Patent: Nov. 30, 1999

[54] ARCHERY BOW ARROW REST

[76] Inventor: Emil Vyprachticky, 7713 Webster Way, Arvada, Colo. 80003

[21] Appl. No.: 08/928,860

[22] Filed: Sep. 12, 1997

[51] Int. Cl.[6] ..... F41B 5/22

[52] U.S. Cl. ..... 124/44.5

[58] Field of Search ..... 124/24.1, 44.5

[56] References Cited

U.S. PATENT DOCUMENTS

| | | | |
|---|---|---|---|
| 4,324,221 | 4/1982 | Peck | 124/44.5 X |
| 5,031,601 | 7/1991 | Gunter | 124/44.5 |
| 5,085,201 | 2/1992 | Tepper et al. | 124/44.5 |
| 5,144,937 | 9/1992 | Colvin | 124/44.5 |
| 5,261,383 | 11/1993 | Halamay | 124/44.5 |
| 5,327,877 | 7/1994 | Shaw | 124/24.1 |
| 5,400,763 | 3/1995 | Mazza | 124/44.5 |
| 5,462,041 | 10/1995 | Solecki | 124/44.5 |

*Primary Examiner*—John A. Ricci
*Attorney, Agent, or Firm*—Richard W. Hanes

[57] ABSTRACT

An arrow rest for an archery bow having a central bow riser, comprising a bracket adapted for attachment to one lateral side of the bow riser and where the bracket supports a pair of adjustably spaced apart disks that are disposed in a single plane that is perpendicular to the plane of the riser. An arrow shaft is supported by the thin circumferential edges of the disks. The bracket includes a guard shield that is elevated above the level of the disks and is spaced outwardly from the disks and the riser to protect the hand of the archer from the sharp edges of an arrow head that may be dislodged from the arrow rest and to limit the fall of the arrow.

4 Claims, 2 Drawing Sheets

ARCHERY BOW ARROW REST

The present invention relates to archery bows and more specifically to an arrow rest for supporting the shaft of the arrow when it placed in position to be shot by the bow.

BACKGROUND

When placed in position to be shot by a bow, the shaft of the arrow is preferably vertically supported and horizontally steadied, as the arrow is drawn with the pull on the bowstring. That same support is desired following release of the bow string by the archer to stabilize the arrow as it leaves the bow on its flight. The supporting device is usually referred to as the arrow rest. The prior art has seen many variations of arrow rests, which go from a simple lip or notch formed in one side of the handle, or central portion, of the bow to the more elegant rests of the modern compound bows. The currently fashionable design for an arrow rest comprises a pair of opposed, spaced apart pointed tongs mounted on a rotatable and laterally slidable shaft. The shaft of the arrow rests on the two distal ends of the tongs. One of the three feathers on the end of the arrow passes between the tongs when the arrow is launched. The position of the opposing tong points can be moderately changed by adjusting the position of the mounting shaft. While it offers little resistance to the arrow by way of friction on the arrow shaft, the primary problem with an arrow rest of this design is its inability to maintain the arrow in position except when the bow is held vertically and not bumped or jarred. When the bow is tipped sideways or bumped there is nothing to hold the arrow shaft on the two prongs of the arrow rest. The arrow falls from its support and shots are missed.

Another type of arrow support is disclosed in U.S. Pat. No. 3,698,375 to George D. Brougham. This earlier Brougham arrow rest appears to provide better support for the arrow than do those being currently sold and used, however, Brougham's device still suffers from the disadvantage of having the arrow fall off of the rest. It would also appear to create more resistance to the flight of the arrow through the friction produced by the greater area of contact between the parts of the arrow rest and the shaft of the arrow.

Accordingly, it is the primary object of the present invention to provide a stabilized platform for an arrow that will not allow the arrow shaft to easily fall off of the support and that will provide minimum surface contact between the support and the arrow shaft to reduce friction.

A further object of the invention is to provide an arrow rest wherein the rest will accommodate arrow shafts of different diameters with only a minimum adjustment of the structure.

Another object of the invention is to combine the working structure of the arrow support with a guard to protect the hand of the archer from being injured by the razor sharp edges of a broadhead fitted arrow.

Other and further objects, features and advantages of the present invention will become apparent upon a reading of the following detailed description of a preferred form of the invention, taken in conjunction with the accompanying drawings.

DETAILED DESCRIPTION

Figure 1:
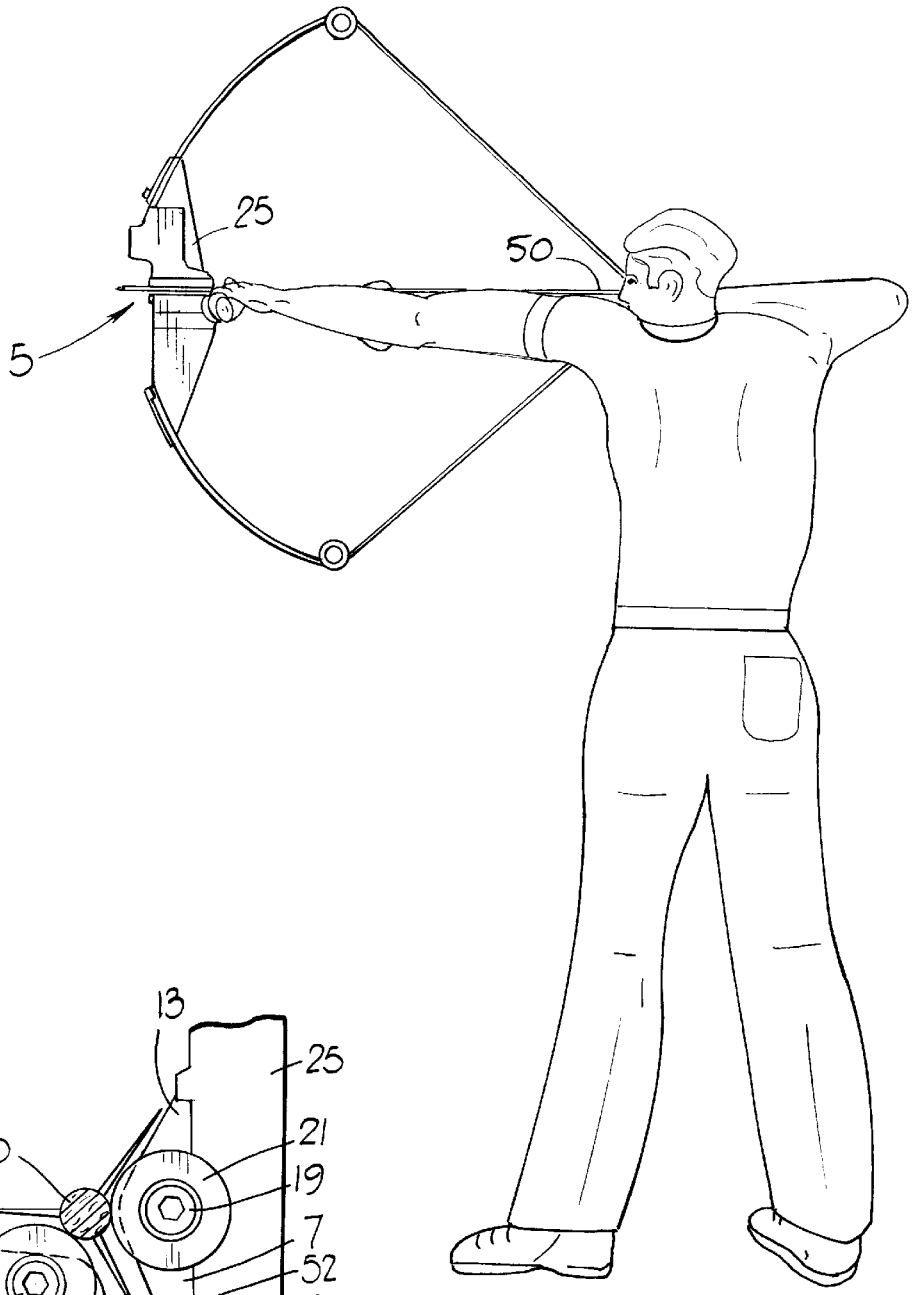
FIG. 1 is a side view of an archer using a bow having the arrow rest of the present invention.
Figure 2:
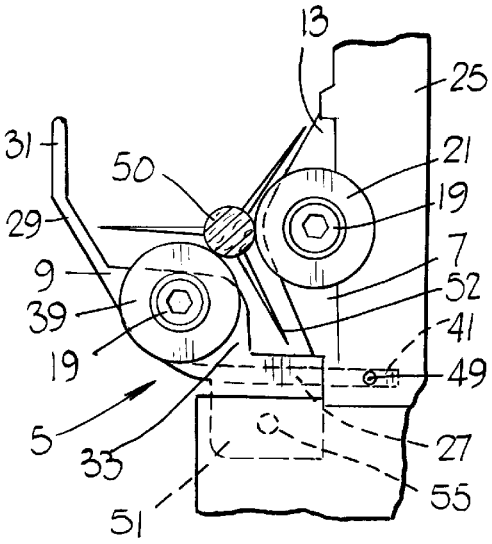
FIG. 2 is an end view of the arrow rest showing an arrow in cross section that is being supported by the arrow rest. Fragmentary portions of the bow riser are also shown.
Figure 3:
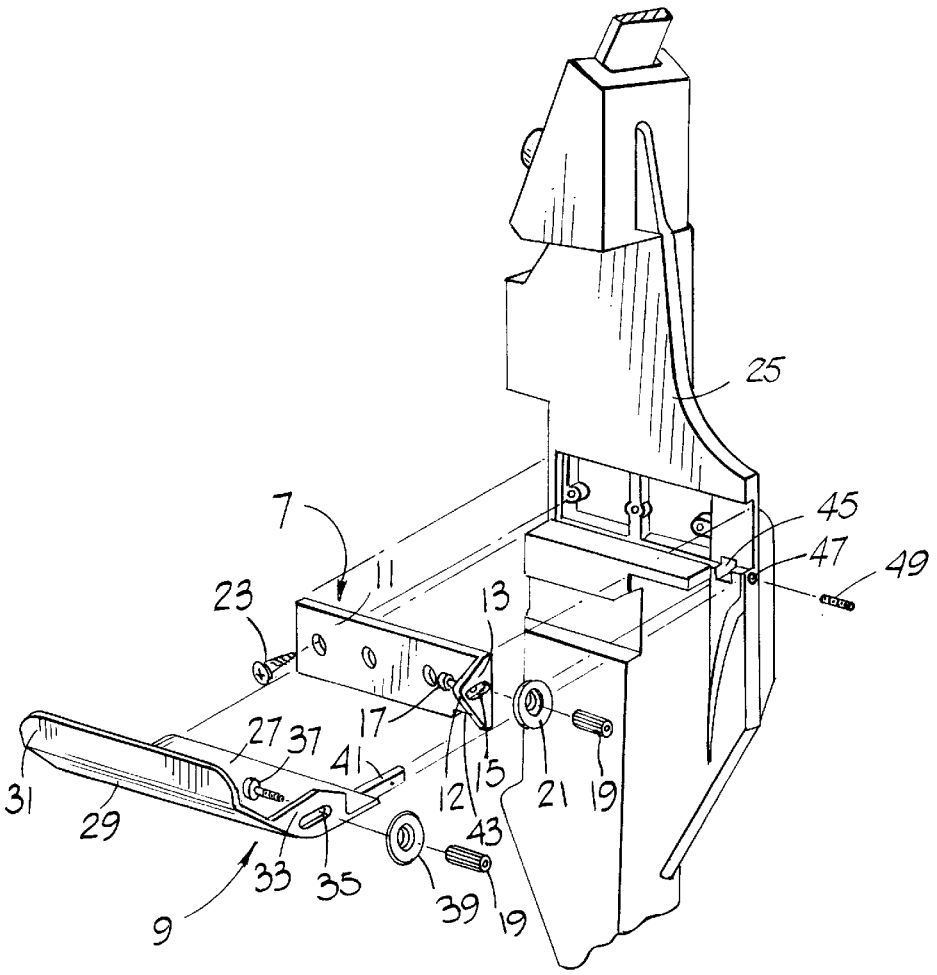
FIG. 3 is a perspective exploded view of the arrow rest and a fragmentary perspective view of a bow riser to which the arrow rest is attached.

The archery bow arrow rest of the present invention preferably includes a two piece bracket 5, as shown in FIGS. 2 and 3. The bracket comprises a mounting side 7 and a guard 9.

The mounting side 7 is constructed of a flat plate 11 with a pyramidal shaped end 13 positioned at right angles to the plane of the flat plate. Near the point of the pyramid on the end 12, a slot 15 is provided to receive a screw or bolt 17 that is threaded into knurled finger nut 19 from the front side of the slot 15. The bolt 17 rotatably supports a circular disk 21, positioned between the pyramidal end 13 and the nut 19. The disk is held securely in place when the bolt 17 is tightened into the nut 19.

The flat plate 11 is drilled to accommodate screws 23 that secure the flat plate to the lateral side of the riser 25 of an archery bow. In some instances the riser can be nothing more than the handle of a bow, however the term "riser" is frequently used in connection with modern compound bows that utilize flexible limbs attached to the riser. Accordingly, the term "riser", as used herein shall be taken to mean the riser of a compound bow or the handle, or similar piece of another type of bow.

The guard 9 of the bracket 5 is preferably constructed of a single piece of sheet metal or molded plastic. The guard comprises an elongated flat bottom plate 27, an angularly related side 29, attached to the bottom plate, and an upstanding edge portion 31. Different configurations of the guard portion of the bracket are possible. The length of the various parts comprising the guard 9 approximate the width, from front to back, of the bow riser or handle. The front of the bow is taken to be that part of the bow nearest the target, while the back or rear portion of the bow is that part containing the bowstring, or the part closest to the body of the archer. A fillet 33 is attached to the guard along the rear facing edges of the bottom 27 and the angularly related side 29. The fillet is perpendicular to the plane of the bottom 27 and when the guard is installed, as will be explained, the fillet 33 is positioned so as to be coplanar with the pyramidal shaped end 13 of the mounting side 7 of the bracket 5. A horizontal slot 35 (the plane of the bow is considered to be vertical) in the fillet 33 is adapted to receive a screw or bolt 37 that is threaded into a second knurled finger nut 19 from the front side of the slot 35. The bolt 37 rotatably supports a circular disk 39, positioned between the fillet 33 and the second nut 19. The disk 39 is held securely in place when the bolt 37 is tightened into the second nut 19. A screw 17 rotatably supports a second circular disk 21 that is held securely in place when the screw or bolt 17 is tightened against the nut 19. The circular disk 21 is rotatably mounted on the screw 17 in a position to be coplanar with the first mentioned disk 39.

Attached to the bottom surface of the flat bottom plate 27 of the guard 9 is an elongated bar 41 of rectangular cross section. The longitudinal axis of the bar is parallel to the plane of the fillet 33. When the bracket 5 is assembled the bar 41 passes through a guide slot 43 in the bottom rearward edge of the flat mounting plate 11 and into a mating rectangular enclosing aperture 45 which is formed in the bow riser 25 perpendicular to the plane of the riser. Rearwardly of the aperture 45 and perpendicular thereto is a threaded bore 47 that receives a set screw 49. The set screw 49 bears against the elongated bar 41 to secure the bar in position. A downwardly bent tab 51, depending from the frontal edge of the bottom plate 27 is provided with an aperture 53 to receive a screw which anchors the front part of the arrow guide to the bow riser 25. (See FIG. 2) In another embodiment of the arrow rest the guard portion and the side mounting portion could be formed as one piece.

Figure 4:
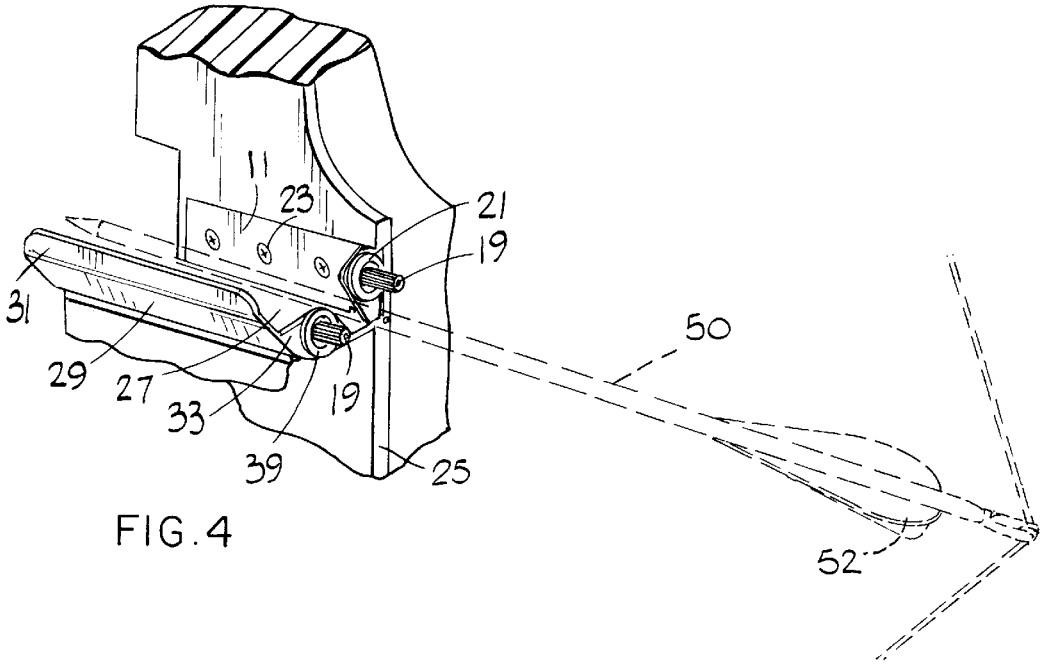
FIG. 4 is a perspective view of the arrow rest shown attached to a fragmentarily shown bow riser. An arrow is shown in dotted lines and a fragment of the drawn bowstring in the nock of the arrow is also shown.

As seen in FIGS. 2 and 4, the shaft of the arrow is cradled by the circumferential edges of the disks 21 and 39. Arrows having small diameter shafts will require that the disks be spaced closer together than would be required for arrows having larger diameter shafts. Adjustment of this spacing of the disk edges is accomplished by loosening the knurled hand nuts 19 and moving the disk carrying bolts 17 and 37 within the slots 15 and 35 so that they are closer together or further apart. When the proper spacing is achieved for the arrow to be used, the nuts 19 are tightened to again secure the disks in place.

The adjustment of the disks 21 and 39, and especially their rotatability, provide a means for changing the point of contact between the arrow's shaft 50 and the circumferential edges of the disk. If the disks become worn and flattened, thus presenting a greater surface area to contact the arrow's shaft, the screws or bolts securing the disk retaining nuts are loosened. The disks are then slightly rotated to a new position where a sharper edge of the disk may be presented to the arrow shaft. Sharper, thinner edges on the disks reduce the friction between the arrow rest and the arrow as the arrow is launched.

In use, the arrow's shaft 50 is placed between the spaced apart edges of the disks 21 and 39 with one of the fletches 52 of the arrow being positioned between the disks, as seen in FIG. 2. The circumferential edges of the disks provide a cradle for the arrow shaft 50 which mitigates against the shaft falling out of the arrow rest toward the angular side 29 and the upstanding guard edge 31. However, if the bow is tilted away from the vertical position to such an extent that the arrow is dislodged it will fall toward the upstanding edge 31 and be caught and restrained by the guard. A simple motion to right the bow to a more vertical position will cause the arrow to come back into its position between the disks without the use of the archer's hands to place it into this position. The angular side 29 and the upstanding edge 31 of the guard 9 serve an additional purpose. That purpose is the source of the descriptive nomenclature for the guard portion of the bracket 5. The side 29 and the upstanding edge 31 serve as a protective shield to guard the archer's hand from being cut by the sharp edges of a broadhead arrow if the arrow is dislodged from the arrow rest. In prior art devices, the arrow head can cause injury to the archer's hand if it falls laterally outwardly from the arrow rest, since there is nothing to arrest its fall except the hand of the archer.

I claim:

1. An arrow rest for an archery bow in which a central bow riser, bow limbs and a bow string are coplanar, comprising, a bracket adapted for attachment to one lateral side of the bow riser, a pair of spaced apart disks carried by the bracket and disposed in a plane perpendicular to the common plane of the riser, the limbs and the bow string for supporting the shaft of the arrow in perpendicular relationship to the plane of the disks.

2. The arrow rest of claim 1 and further including, shield means carried by the bracket and disposed laterally of the disks for arresting the fall of an arrow dislodged from its position of support by the disks.

3. The arrow rest of claim 1 where the disks are rotatably mounted on the bracket.

4. The arrow rest of claim 1, where the bracket comprises, first and second portions, and means adjustably interconnecting the first and second portions for varying the coplanar spacing between the disks.

* * * * *